US008614175B2

(12) United States Patent
Yoon et al.

(10) Patent No.: US 8,614,175 B2
(45) Date of Patent: Dec. 24, 2013

(54) CLEANING SOLUTION COMPOSITION FOR A SOLAR CELL

(75) Inventors: Hyo-Joong Yoon, Iksan-si (KR); Soon-Hong Bang, Iksan-si (KR); Sang-Tae Kim, Iksan-si (KR); Seung-Yong Lee, Iksan-si (KR)

(73) Assignee: Dongwoo Fine-Chem Co., Ltd. (KR)

( * ) Notice: Subject to any disclaimer, the term of this patent is extended or adjusted under 35 U.S.C. 154(b) by 0 days.

(21) Appl. No.: 13/380,389

(22) PCT Filed: Jun. 23, 2010

(86) PCT No.: PCT/KR2010/004074

§ 371 (c)(1), (2), (4) Date: Dec. 22, 2011

(87) PCT Pub. No.: WO2010/151045

PCT Pub. Date: Dec. 29, 2010

(65) Prior Publication Data

US 2012/0090670 A1 Apr. 19, 2012

(30) Foreign Application Priority Data

Jun. 24, 2009 (KR) ..... 10-2009-0056543

(51) Int. Cl.

| | |
|---|---|
| ***C11D 3/36*** | (2006.01) |
| ***C11D 3/395*** | (2006.01) |
| ***C11D 3/26*** | (2006.01) |
| ***C11D 3/43*** | (2006.01) |

(52) U.S. Cl.

USPC ..... 510/182; 510/175; 510/254; 510/367; 510/372; 510/432; 510/436; 510/504

(58) Field of Classification Search

USPC ..... 510/175, 182, 254, 367, 372, 432, 436, 510/504

See application file for complete search history.

(56) References Cited

U.S. PATENT DOCUMENTS

| | | | | |
|---|---|---|---|---|
| 5,290,361 | A | 3/1994 | Hayashida et al. | |
| 6,010,994 | A * | 1/2000 | Choy et al. | 510/312 |
| 6,514,352 | B2 | 2/2003 | Gotoh et al. | |
| 7,235,516 | B2 | 6/2007 | Morinaga et al. | |
| 7,994,420 | B2 | 8/2011 | Harder et al. | |
| 2012/0283165 | A1 * | 11/2012 | Man et al. | 510/491 |

FOREIGN PATENT DOCUMENTS

| | | | |
|---|---|---|---|
| CN | 101032033 | A | 9/2007 |
| JP | 05-275405 | A | 10/1993 |
| JP | 11-279590 | A | 10/1999 |
| JP | 2003-221600 | A | 8/2003 |
| JP | 2005-026621 | A | 1/2005 |
| JP | 2005-223030 | A | 8/2005 |
| KR | 10-2002-0028835 | A | 4/2002 |
| KR | 10-2005-0103953 | A | 11/2005 |
| KR | 10-2007-0023954 | A | 3/2007 |
| KR | 10-0813753 | B1 | 3/2008 |
| WO | WO-2004/074597 | A1 | 9/2004 |

OTHER PUBLICATIONS

"Chinese Application Serial No. CN201080028674.2, Office Action dated Sep. 12, 2012", (w/ English Translation), 7 pgs.
"International Application No. PCT/KR2010/004074, International Search Report and Written Opinion mailed Feb. 23, 2011", (w/ English Translation), 8 pgs.
"Chinese Application Serial. No. 201080028674.2, Office Action mailed Jun. 3 2013", (w/ English Translation), 7 pgs.

* cited by examiner

*Primary Examiner* — Charles Boyer
(74) *Attorney, Agent, or Firm* — Schwegman, Lundberg & Woessner, P.A.

(57) ABSTRACT

Disclosed herein is a cleaning solution composition for a solar cell, comprising: organic alkali compounds, water-soluble glycol ether compounds, percarbonates, organic phosphoric acids or salts thereof, and water.

5 Claims, No Drawings

CLEANING SOLUTION COMPOSITION FOR A SOLAR CELL

PRIORITY CLAIM TO RELATED APPLICATIONS

This application is a national stage application under 35 U.S.C. §371 of PCT/KR2010/004074, filed Jun. 23, 2010, and published as WO 2010/151045 A2 on Dec. 29, 2010, which claims priority to Korean Application No. 10-2009-0056543, filed Jun. 24, 2009, which applications and publication are incorporated herein by reference and made a part hereof in their entirety, and the benefit of priority of each of which is claimed herein.

BACKGROUND OF THE INVENTION

1. Technical Field

The present invention relates to a cleaning solution composition for a solar cell. More specifically, the present invention relates to a cleaning solution composition for a silicon wafer used to manufacture a solar cell.

This application claims the benefit of Korean Patent Application No. 10-2009-0056543, filed on Jun. 24, 2009, which is hereby incorporated by reference in its entirety into this application.

2. Description of the Related Art

Silicon solar cells are classified into monocrystalline silicon solar batteries, polycrystalline silicon solar batteries and amorphous silicon solar batteries.

A method of manufacturing a silicon solar cell is described as follows. In the case of a monocrystalline silicon solar cell, first, a monocrystalline ingot formed by a crystal pulling method is cut into sheets. A sawing tool may be a wire saw. Subsequently, the sheets are processed to a thickness of 100~200 μm to form a wafer. Subsequently, a p-n junction layer, electrodes, a protective film and the like are sequentially formed on the wafer, thereby completing a monocrystalline silicon solar cell. Further, in the case of a polycrystalline silicon solar cell, molten silicon prepared by casting is cooled and crystallized to form a polycrystalline silicon ingot. Subsequently, the polycrystalline silicon ingot is cut into sheets. Subsequently, the sheets are processed to a thickness of 100~200 μm to form a wafer. Subsequently, a p-n junction layer, electrodes, a protective film and the like are sequentially formed on the wafer, thereby completing a polycrystalline silicon solar cell.

In the method of manufacturing a silicon solar cell, in order to prevent the damage of the cut surface of the ingot and to decrease the reflectance of the cut surface thereof during the sawing process, a texturing process wherein the cut surface thereof is made uneven using a basic or acidic solution may be conducted. However, during the texturing process, the cut surface of the ingot may not be uniformly textured by the sawing oil or lubricating oil used in the sawing process, organic pollutants such as fingerprints and the like, glove prints or particulate pollutants occurring during the process of being handled by a worker, and belt prints transferred from conveyor belts. When the cut surface of the ingot is not uniformly textured, the yield of manufacturing solar batteries decreases rapidly, thus decreases the processability.

Therefore, in the solar cell manufacturing industry, RCA cleaning, which is used in semiconductor cleaning, was introduced in order to solve the problems related to organic pollutants, particulate pollutants and the like. More specifically, in the solar cell manufacturing industry, only SC-1 (SPM, hydrogen peroxide: ammonia: pure water) was introduced into the initial cleaning of solar cell wafer during RCA cleaning, or RCA cleaning was directly applied to the entire texturing process. However, when SC-1 cleaning or RCA cleaning is used, it is difficult to remove pollutants that are not particles. Further, when SC-1 cleaning or RCA cleaning is used, processing costs are increased because a solar cell manufacturing process needs additional processes. Further, when SC-1 cleaning or RCA cleaning is used, it is difficult to conduct work because the process temperature is 70~100° C.

Accordingly, various attempts to overcome the problems of SC-1 cleaning or RCA cleaning have been made. For example, Korean Unexamined Patent Application Publication No. 2007-0023954 discloses a method of cleaning a substrate using ozone water instead of hydrogen peroxide in the SC-1 solution. This method is advantageous in that the effects of removing organic pollutants can be improved because ozone water, which is an oxidant that is not harmful to the environment and is stronger than hydrogen peroxide, is used. However, this method is problematic in that the process temperature for SC-1 cleaning must be maintained constant, and an ozone generator must be additionally provided. Further, Japanese Unexamined Patent Application Publication No. H05-275405 and Japanese Unexamined Patent Application Publication No. 2003-221600 disclose a detergent solution prepared by adding a complexing agent such as a phosphonate compound or a condensed phosphate compound to an SC-1 solution or adding an ethylene oxide-added surfactant or complexing agent to the SC-1 solution. This detergent solution can remove metal particles, but cannot efficiently remove organic pollutants, particulate pollutants and pollutants attributable to equipment. Further, Korean Unexamined Patent Application Publication No. 2005-0103953 discloses a semiconductor cleaning solution composition essentially comprising quaternary ammonium hydroxide and a specific surfactant. However, the semiconductor cleaning solution composition is problematic in that the performance of removing fat or particulate pollutants is not excellent.

SUMMARY OF THE INVENTION

Accordingly, the present invention has been devised to solve the above-mentioned problems. An object of the present invention is to provide a cleaning solution composition, which can exhibit excellent cleaning effects of removing pollutants remaining on a substrate for solar batteries because the cleaning solution composition has excellent wetting and permeability.

Another object of the present invention is to provide a cleaning solution composition which does not have a negative influence on a texturing process that is a kind of post process, and which can improve the manufacturing yield of solar batteries.

In order to accomplish the objects, the present invention provides a cleaning solution composition for a solar cell, comprising: organic alkali compounds; water-soluble glycol ether compounds; percarbonates; organic phosphoric acids or salts thereof; and water.

Further, the present invention provides a solar cell washed with the cleaning solution composition.

Further, the present invention provides a solar cell module comprising the solar cell.

The cleaning solution composition of the present invention is advantageous in that it can effectively remove pollutants remaining on a substrate for solar batteries because it has excellent wetting and permeability. Further, the cleaning solution composition of the present invention is advantageous in that it can improve the manufacturing yield of solar batteries because it does not have a negative influence on a texturing process which is a post process.

DESCRIPTION OF THE PREFERRED EMBODIMENTS

Hereinafter, the present invention will be described in detail.

The present invention relates to a cleaning solution composition for silicon wafer used in a solar cell, comprising: organic alkali compounds, water-soluble glycol ether compounds, percarbonates, organic phosphoric acids or salts thereof, and water.

The cleaning solution composition is advantageous in that it exhibits excellent cleaning effects in the washing of a substrate before-after a texturing process during the solar cell manufacturing process, and in that it does not negatively influence the texturing process. In particular, the cleaning solution composition can be effectively used to wash a monocrystalline silicon wafer, polycrystalline silicon wafer for a solar cell. The cleaning solution composition may comprise, based on the total amount thereof: 0.1~15 wt % of organic alkali compounds, 0.1~40 wt % of water-soluble glycol ether compounds, 0.1~20 wt % of percarbonates, 0.01~10 wt % of organic phosphoric acids or salts thereof, and residual water.

In the cleaning solution composition, examples of the organic alkali compounds may include amines and alkanolamines. Preferably, examples of the organic alkali compounds may include: primary amines, such as methylamine, ethylamine, isopropylamine, monoisopropylamine, and the like; secondary amines, such as diethylamine, diisopropylamine, dibutylamine, and the like; tertiary amines, such as trimethylamine, triethylamine, triisobutylamine, tributylamine, and the like; quaternary ammonium hydroxides, such as tetramethylammonium hydroxide, tetraethylammonium hydroxide, tetrapropylammonium hydroxide, tetrabutylammonium hydroxide, and the like; and alkanolamines, such as cholinehydroxide, monoethanolamine, diethanolamine, 2-aminoethanol, 2-(ethylamino)ethanol, 2-(methylamino)ethanol, N-methyldiethanolamine, dimethylaminoethanol, diethylaminoethanol, 2-(2-aminoethoxy)ethanol, 1-amino-2-propanol, triethanolamine, monopropanolamine, and dibutanolamine, and the like.

Among them, it is more preferred that examples of the organic alkali compounds include tetramethylammonium hydroxide, tetraethylammonium hydroxide, tetrapropylammonium hydroxide, tetrabutylammonium hydroxide, monoethanolamine, and 1-amino-2-propanol.

The amount of the organic alkali compounds may be 0.1~15 wt %, preferably, 0.5~10 wt %, based on the total amount of the cleaning solution composition. When the amount of the organic alkali compound is below 0.1 wt %, it is difficult to expect enough cleaning ability to remove particles and organic/inorganic pollutants. Further, when the amount of the organic alkali compounds is above 15 wt %, the alkalinity of the cleaning solution composition becomes high, so that the surface of a substrate can be etched, thereby negatively influencing the texturing process which is a post process.

The water-soluble glycol ether compounds remove oil components, such as lubricating oil, sawing oil, fingerprints and the like, which are difficult to remove with just an aqueous solution including the organic alkali compounds and which remain on the surface of a substrate. Further, the water-soluble glycol ether compounds serve to increase the solubility of the cleaning solution composition in water. The water-soluble glycol ether compounds may be water-soluble glycol ether compounds of $C_1$~$C_{10}$. Examples of the water-soluble glycol ether compounds of $C_1$~$C_{10}$ may include ethyleneglycol monomethyl ether (MG), diethyleneglycol monomethyl ether (MDG), triethyleneglycol monomethyl ether (MTG), polyethyleneglycol monomethyl ether (MPG), ethyleneglycol monoethyl ether (EG), diethyleneglycol monoethyl ether (EDG), ethyleneglycol monobutyl ether (BG), diethyleneglycol monobutyl ether (BDG), triethyleneglycol monobutyl ether (BTG), propyleneglycol monomethyl ether (MFG), and dipropyleneglycol monomethyl ether (MFDG). These water-soluble glycol ether compounds may be used independently or may be used in the form of a mixture of two or more.

The amount of the water-soluble glycol ether compounds may be 0.1~40 wt %, preferably, 1.0~20 wt %, based on the total amount of the cleaning solution composition. When the amount of the water-soluble glycol ether compounds is below 0.1 wt %, it becomes difficult to remove the oil components remaining on the surface of a substrate. Further, when the amount of the water-soluble glycol ether compounds is above 40 wt %, the viscosity of the cleaning solution composition is increased, so that the wetting and permeability of the cleaning solution composition into the substrate is negatively influenced by the increase in viscosity of the cleaning solution composition, with the result that it becomes difficult to expect cleaning effects.

The percarbonates are easily dissolved in water to generate active oxygen, and the active oxygen can easily oxidize particulate pollutants and organic pollutants remaining on the surface of a substrate. Therefore, the percarbonates serve to help the pollutants to easily decompose and dissolve. Examples of the percarbonates may include sodium percarbonate, potassium percarbonate, and the like. Considering industrial productivity and price, sodium percarbonate is the most preferable.

The amount of the percarbonates may be 0.1~20 wt %, preferably, 1.0~10 wt %, based on the total amount of the cleaning solution composition. When the amount of the percarbonates is below 0.1 wt %, it is difficult to expect the cleaning effects of the cleaning solution composition to the surface of a substrate. Further, when the amount of the percarbonates is above 20 wt %, the solubility of the cleaning solution composition in water reaches its maximum, and the cleaning effect attributable to oxidation does not linearly increase although the amount thereof increases.

The organic phosphoric acids or the salts thereof strongly bond with inorganic ions and serve to disperse impurity particles so as not to allow them to conglomerate with each other. Therefore, the organic phosphoric acids or the salts thereof have an excellent ability to remove organic/inorganic pollutants. Further, the organic phosphoric acids or the salts thereof serve as a stabilizer for an oxidant such as percarbonates, thus preventing the oxidant from early decomposing, so as to allow the cleaning solution composition to exhibit an excellent cleaning effect.

The organic phosphoric acids or the salts thereof are not particularly limited as long as it is generally used in the related field. The organic phosphoric acids or the salts thereof may be one or more selected from the group consisting of methyldiphosphonic acid, aminotri(methylenephosphonic acid), ethylidenediphosphonic acid, 1 -hydroxyethylidene-1, 1-diphosphonic acid, 1-hydroxypropylidene-1, 1-diphosphonic acid, 1-hydroxybutylidene-1, 1-diphosphonic acid, ethylaminobis(methylenephosphonic acid), 1,2-propylenediaminetetra(methylenephosphonic acid), dodecylaminobis (methylenephosphonic acid), nitrotris(methylenephosphonic acid), ethylenediaminebis(methylenephosphonic acid), ethylenediaminetetra(methylenephosphonic acid), hexenediaminetetra(methylenephosphonic acid), diethylenetriaminepenta(methylenephosphonic acid), cyclohexanediaminetetra (methylenephosphonic acid), and salts thereof. Here, it is preferred that the salts of the organic phosphoric acids be a potassium salt or sodium salt thereof.

The amount of the organic phosphoric acids or the salts thereof may be 0.01~10 wt %, preferably, 0.1~5 wt %, based on the total amount of the cleaning solution composition. When the amount of the organic phosphoric acids or the salts thereof is below 0.01 wt %, it is difficult to expect the cleaning and stabilizing effects of the cleaning solution composition. Further, when the amount of the organic phosphoric acids or the salts thereof is above 10 wt %, the cleaning and stabilizing effects of the cleaning solution composition do not increase linearly with the increase in the amount thereof.

The water comprised of the cleaning solution composition of the present invention is not particularly limited, but may be deionized water having a specific resistance of 18 MΩ/cm, which is used in semiconductor processes. The amount of the water used may be adjusted depending on the amounts of the other components.

The cleaning solution composition of the present invention may further include additives commonly known in the related field, for example, an anticorrosive, a wetting and penetrating agent, a dispersant, a surface modifier and the like.

Further, the present invention provides a solar cell washed with the cleaning solution composition.

Further, the present invention provides a solar cell module comprising the solar cell.

Hereinafter, the present invention will be described in reference to the following Examples. However, the following Examples are set forth to illustrate the present invention in more details, and the scope of the present invention is not limited thereto.

EXAMPLES 1 To 8 AND COMPARATIVE EXAMPLES 1 To 4

Preparation of Cleaning Solution Compositions

Cleaning solution compositions were prepared by introducing the components given in Table 1 below into a mixer provided with a stirrer and then stirring the components at a speed of 500 rpm at room temperature for 1 hour.

Test Example

Cleaning Effects and Texturing Effects

1. Sawing Oil Removal Effects 100 mL of the cleaning solution compositions prepared in Examples 1 to 8 and Comparative Examples 1 to 4 were put into a 250 mL beaker, and then a silicon wafer substrate (2 cm×2 cm) for solar batteries, to which a drop of sawing oil added, was dipped into the cleaning solution compositions for 5 minutes, thus conducting a cleaning process. After the cleaning process was conducted for a predetermined amount of time, the silicon wafer substrate was taken out of the beaker, washed with ultrapure water for 1 minute, and then rinsed. Subsequently, liquid was removed from the surface of the silicon wafer substrate using nitrogen gas, and then the silicon wafer substrate was observed with the naked eye. Subsequently, the silicon wafer substrate was textured using a texturing chemical commonly used in the related field, and then the surface of the textured silicon wafer substrate was examined with the naked eye, an optical microscope and a scanning electron microscope (SEM) (S-4700, manufactured by Hitachi AIC, Inc.) to ascertain whether post processes had completed well despite foreign materials remaining on the surface of the silicon wafer substrate, thereby evaluating the cleaning effects and texturing effects of the cleaning solution compositions. The results thereof are given in Table 1 below.

2. Fingerprint Removal Effects 100 mL of the cleaning solution compositions prepared in Examples 1 to 8 and Comparative Examples 1 to 4 were put into a 250 mL beaker, and then a silicon wafer substrate (2 cm×2 cm) for solar batteries, on which fingerprints were imprinted and then left for a predetermined time, was dipped into the cleaning solution compositions for 5 minutes, thus conducting a cleaning process. After the cleaning process was conducted for a predetermined amount of time, the silicon wafer substrate was taken out of the beaker, washed with ultrapure water for 1 minute, and then rinsed. Subsequently, liquid was removed from the surface of the silicon wafer substrate using nitrogen gas, and then the silicon wafer substrate was observed with the naked eye. Subsequently, the silicon wafer substrate was textured using a texturing chemical commonly used in the related field, and then the surface of the textured silicon wafer substrate was examined with the naked eye, an optical microscope and a scanning electron microscope (SEM) (S-4700, manufactured by Hitachi AIC, Inc.) to ascertain whether post processes had completed well despite foreign materials remaining on the surface of the silicon wafer substrate, thereby evaluating the cleaning effects and texturing effects of the cleaning solution compositions. The results thereof are given in Table 1 below.

| | Organic alkali compound (wt %) | Glycol ether (wt %) | Percarbonate (wt %) | Organic phosphate (wt %) | Water (wt %) | Sawing oil removal effect | Fingerprint removal effect | Texturing state |
|---|---|---|---|---|---|---|---|---|
| Exp. 1 | TMAH 5 | MDG 15 | SPC 5 | HEDP 5 | residual | ◎ | ◎ | ○ |
| Exp. 2 | TMAH 5 | MDG 20 | PPC 5 | ATMP 5 | residual | ◎ | ◎ | ◎ |
| Exp. 3 | TMAH 10 | BDG 15 | SPC 5 | HEDP 5 | residual | ◎ | ◎ | ◎ |
| Exp. 4 | TMAH 10 | BDG 20 | PPC 5 | ATMP 5 | residual | ◎ | ◎ | ◎ |
| Exp. 5 | TEAH 5 | MDG 15 | SPC 5 | HEDP 5 | residual | ◎ | ◎ | ○ |
| Exp. 6 | TEAH 5 | MDG 20 | PPC 5 | ATMP 5 | residual | ◎ | ◎ | ◎ |

-continued

| | Organic alkali compound (wt %) | Glycol ether (wt %) | Percarbonate (wt %) | Organic phosphate (wt %) | Water (wt %) | Sawing oil removal effect | Fingerprint removal effect | Texturing state |
|---|---|---|---|---|---|---|---|---|
| Exp. 7 | TEAH 10 | BDG 15 | SPC 5 | HEDP 5 | residual | ◎ | ◎ | ◎ |
| Exp. 8 | TEAH 10 | BDG 20 | PPC 5 | ATMP 5 | residual | ◎ | ◎ | ◎ |
| Comp. Exp. 1 | TMAH 5 | — | — | — | residual | X | X | X |
| Comp. Exp. 2 | — | BDG 20 | — | — | residual | Δ | X | X |
| Comp. Exp. 3 | TMAH 5 | MDG 15 | SPC 5 | — | residual | ○ | ○ | X |
| Comp. Exp. 4 | TEAH 5 | — | — | — | residual | X | X | X |

[Cleaning effects] ◎: very good, ○: good, Δ: normal, X: poor
TMAH: tetramethylammonium hydroxide
TEAH: tetraethylammonium hydroxide
MDG: diethyleneglycol monomethyl ether
BDG: diethyleneglycol monobutyl ether
SPC: sodium percarbonate
PPC: potassium percarbonate
HEDP: 1-hydroxyethylidene-1,1-diphosphonic acid
ATMP: aminotri(methylenephosphonic acid)

It can be seen from the results given in Table 1 above that all of the cleaning solution compositions of Examples 1 to 8 exhibit excellent cleaning effects, and do not negatively influence a texturing process.

Conversely, it can be seen from the results given in Table 1 above that the cleaning solution compositions of Comparative Examples 1 to 4 have low performance in terms of removing organic pollutants such as fingerprints, sawing oil and the like, so that the pollutants remain on the surface of a substrate to form spots thereon, with the result that a texturing process cannot be properly conducted, thereby they cannot be used.

What is claimed is:

1. A cleaning solution composition for a solar cell, comprising: based on a total amount thereof: 0.1~15 wt % of one or more selected from the group consisting of tetramethylammonium hydroxide, tetraethylammonium hydroxide, tetrapropylammonium hydroxide, and tetrabutylammonium hydroxide; 0.1~40 wt % of water-soluble glycol ether compounds; 0.1~20 wt % of percarbonates; 0.01~10 wt % of organic phosphoric acids or salts thereof; and residual water.

2. The cleaning solution composition according to claim 1, wherein the water-soluble glycol ether compounds are water-soluble glycol ether compounds of $C_1$~$C_{10}$.

3. The cleaning solution composition according to claim 2, wherein the water-soluble glycol ether compounds include one or more selected from the group consisting of ethyleneglycol monomethyl ether (MG), diethyleneglycol monomethyl ether (MDG), triethyleneglycol monomethyl ether (MTG), polyethyleneglycol monomethyl ether (MPG), ethyleneglycol monoethyl ether (EG), diethyleneglycol monoethyl ether (EDG), ethyleneglycol monobutyl ether (BG), diethyleneglycol monobutyl ether (BDG), triethyleneglycol monobutyl ether (BTG), propyleneglycol monomethyl ether (MFG), and dipropyleneglycol monomethyl ether (MFDG).

4. The cleaning solution composition according to claim 1, wherein the percarbonates include one or more selected from sodium percarbonate and potassium percarbonate.

5. The cleaning solution composition according to claim 1, wherein the organic phosphoric acids or the salts thereof include one or more selected from the group consisting of methyldiphosphonic acid, aminotri(methylenephosphonic acid), ethylidenediphosphonic acid, 1-hydroxyethylidene-1,1-diphosphonic acid, 1-hydroxypropylidene-1,1-diphosphonic acid, 1-hydroxybutylidene-1,1-diphosphonic acid, ethylaminobis(methylenephosphonic acid), 1,2-propylenediaminetetra(methylenephosphonic acid), dodecylaminobis(methylenephosphonic acid), nitrotris(methylenephosphonic acid), ethylenediaminebis(methylenephosphonic acid), ethylenediaminetetra(methylenephosphonic acid), hexenediaminetetra(methylenephosphonic acid), diethylenetriaminepenta(methylenephosphonic acid), cyclohexanediaminetetra(methylenephosphonic acid), and salts thereof.

* * * * *

UNITED STATES PATENT AND TRADEMARK OFFICE

CERTIFICATE OF CORRECTION

PATENT NO. : 8,614,175 B2
APPLICATION NO. : 13/380389
DATED : December 24, 2013
INVENTOR(S) : Yoon et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 23 days.

Signed and Sealed this
Twenty-second Day of September, 2015

Michelle K. Lee

Michelle K. Lee
*Director of the United States Patent and Trademark Office*